US005951327A

United States Patent [19]

Marik

[11] Patent Number: 5,951,327

[45] Date of Patent: Sep. 14, 1999

[54] CONNECTOR FOR USE WITH MULTIPLE SIZES OF CABLES

[75] Inventor: Greg Marik, Germantown, Tenn.

[73] Assignee: Thomas & Betts International, Inc., Sparks, Nev.

[21] Appl. No.: 08/939,258

[22] Filed: Sep. 29, 1997

[51] Int. Cl.[6] ..... H01R 9/03

[52] U.S. Cl. ..... 439/610

[58] Field of Search ..... 439/610, 98, 579, 439/580, 583

[56] References Cited

U.S. PATENT DOCUMENTS

| | | | |
|---|---|---|---|
| 3,485,517 | 12/1969 | Howe . | |
| 3,739,076 | 6/1973 | Schwartz . | |
| 4,030,742 | 6/1977 | Eidelberg et al. . | |
| 4,273,405 | 6/1981 | Law . | |
| 4,350,840 | 9/1982 | Michaels . | |
| 4,515,991 | 5/1985 | Hutchison . | |
| 4,525,000 | 6/1985 | Bachle . | |
| 4,547,623 | 10/1985 | Van Brunt et al. . | |
| 4,549,755 | 10/1985 | Kot et al. . | |
| 5,059,747 | 10/1991 | Bawa et al. | 174/65 SS |
| 5,208,427 | 5/1993 | Couto et al. | 174/65 SS |
| 5,295,851 | 3/1994 | Bawa et al. | 439/273 |
| 5,321,205 | 6/1994 | Bawa et al. | 174/65 SS |

*Primary Examiner*—Steven L. Stephan
*Assistant Examiner*—Eugene G. Byrd
*Attorney, Agent, or Firm*—Hoffmann & Baron, LLP

[57] ABSTRACT

A connector provides for the termination of a first electrical cable and a second electrical cable where each cable includes a plurality of conductors extending through an outer jacket. The first cable has a diameter which is larger than the second cable. An elongate gland body includes a cable receiving end, a conductor egressing end and a longitudinal center bore therethrough for receipt of the first and second cables individually. A gland nut is positioned in axial alignment with the gland body and is attachable thereto. First and second resilient sealing members are positioned between the gland body and gland nut and are resiliently deformable for effecting a cable seal. A portion of first sealing member is resiliently deformable through an opening in the gland nut and the second sealing member is urged into frictional engagement with the first sealing member upon termination of the second cable in the connector. An insert member is also provided which is positionable within the conductor egressing end of the gland body so as to accommodate and precisely locate the second cable in the connector.

17 Claims, 4 Drawing Sheets

CONNECTOR FOR USE WITH MULTIPLE SIZES OF CABLES

FIELD OF THE INVENTION

The present invention relates to a connector for terminating an electrical cable. More particularly, the present invention relates to a range taking electrical connector and a kit of parts adapted for terminating electrical cables of different diameter.

BACKGROUND OF THE INVENTION

Electrical connectors have long been used to terminate and connect a variety of cables which carry electrical power or signals. Electrical cables, such as those carrying power, are supplied in various configurations based upon a particular application or the location in which the cables are to be used. One type of electrical cable includes plural insulated conductors extending within an outer insulated jacket. Such cables may also include an inner metallic sheath or cladding between the outer jacket and the conductors. Connectors of the type used to terminate such cables must provide for field engagement between the outer jacket of the cable and the connector. These connectors must also provide for grounded electrical engagement between the cladding of the cable and the body of the connector.

The electrical connectors of this type are typically designed to uniquely terminate one size of electrical cable. This is due in part due to the intricate components which must be employed to effectively seal the cable and the connector and to adequately establish ground connection between the cladding of cable and the connector body. Also the cable must be precisely located within the connector to assure proper ground termination. It is generally difficult to properly locate cables of different sizes in a single connector.

One such connector which may be used to terminate a metal clad electrical cable is shown and described in commonly signed U.S. Pat. No. 5,059,747 and which is incorporated by reference herein for all purposes. The connector described in the '747 patent provides for field termination of the metal clad electrical cable by effectively establishing a seal between the connector body and the jacket of the cable. This connector also establishes ground connection between the connector body and the metallic jacket of the cable. The connector of the '747 patent provides the ability to accommodate cables of different diameters by providing a grounding element which accommodates metal cladding of different diameters. Thus the connector of the '747 patent provides a range taking feature with respect to the metal cladding of the cable.

While it is known to provide a range taking feature with respect to the ground connection to the metal cladding, is more difficult to provide an effective seal in such a range taking environment. Further, precise location of cables of different sizes is typically not contemplated.

It is therefore desirable to provide an electrical connector which accommodates cable of different sizes and also adequately locates and positions the different sized cables within the body of the connector.

SUMMARY OF INVENTION

It is an object of the present invention to provide an electrical connector which mechanically and electrically terminates a metal clad cable.

It is a further object of the present invention to provide an electrical connection which accommodates different sized electrical cables and which provides for mechanical and electrical connection of such different sized cables.

It is a still further object of the present invention to provide a connector which properly locates cables of different sizes within the electrical connector for mechanical and electrical termination therein.

In the efficient attainment of the foregoing and other objects of the present invention provides a connector for alternatively terminating a first electrical cable and a second electrical cable. The first and second electrical cables each include a plurality of conductors extending through an outer jacket. The outer jacket of the first cable has a diameter larger than the outer jacket of the second cable. The connector includes an elongate gland body having a cable receiving end, a conductor egressing end and a longitudinal center bore therethrough. The gland nut, having a cable passage opening therethrough, is positioned in an axial alignment with the gland body and is then attachable thereto to secure the cable in the connector. The first and second resilient sealing members are positioned between the gland body and the gland nut and are resiliently deformable for effecting a cable seal upon attachment of the gland nut to the gland body. A portion of first sealing member is resiliently deformable through the gland nut opening and the second sealing member is urged into frictional engagement with the first sealing member upon termination of the second cable in the connector.

In a preferred embodiment of the present invention a kit of parts is provided to terminate an electrical cable. The kit includes a connector gland body and a connector gland nut for attachment to the body. The sealing means is positionable between the gland nut and the gland body for seal termination of the cable in the connector. An insert member is adapted for insertion into the conductor egressing end of the gland body so as to engage the second cable and positionally confine it proper location for mechanical and electrical termination with the connector.

Figure 1:
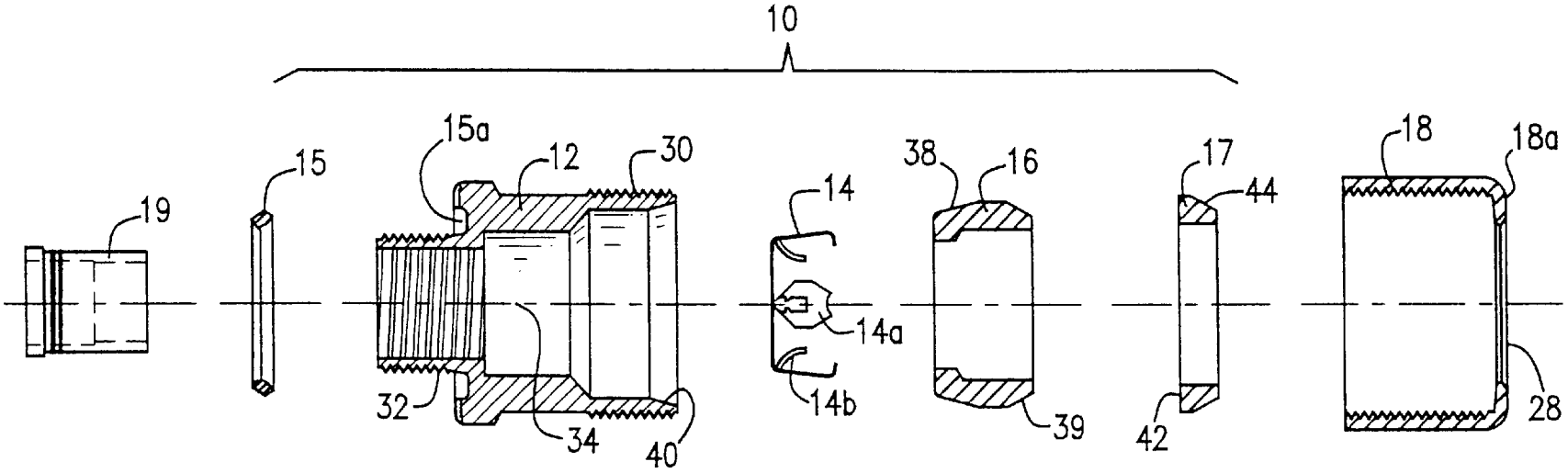
FIG. 1 is an exploded sectional showing of the electrical connector of the present invention.

DETAILED DESCRIPTION OF THE PREFERRED EMBODIMENT:

Referring to FIG. 1, a connector 10 of the present invention is shown. Connector 10 includes a connector gland or gland body 12, a grounding element 14, sealing bushings 16 and 17 and a gland nut 18. Gland body 12, grounding element 14 and gland nut 18 are formed of a suitable conductive metal preferably aluminum. Sealing bushings 16 and 17 are formed of rubber or other suitable elastomer. Connector 10 further includes a resilient sealing ring 19 and an insert element 19 adjacent to the front end thereof. The sealing ring 15 is also formed of a suitable elastomer and the insert member 19 may be formed of a suitably rigid plastic.

Connector 10 of the present invention is substantially essentially similar to the connector shown and described in commonly assigned U.S. Pat. No. 5,059,747, issued Oct. 22, 1991, which is incorporated by reference herein. Furthermore, resilient sealing ring 15 is substantially similar to the sealing ring shown and described in commonly assigned U.S. Pat. No. 5,295,851, issued Mar. 22, 1994, which is also incorporated by reference herein. Sealing ring 15 is positioned within an annular groove 15*a* at the front end of the gland body 12 and provides a seal between the gland body 12 and a wall or panel of a electrical junction box (not shown) or other device to which connector 10 may be connected.

Figure 2:
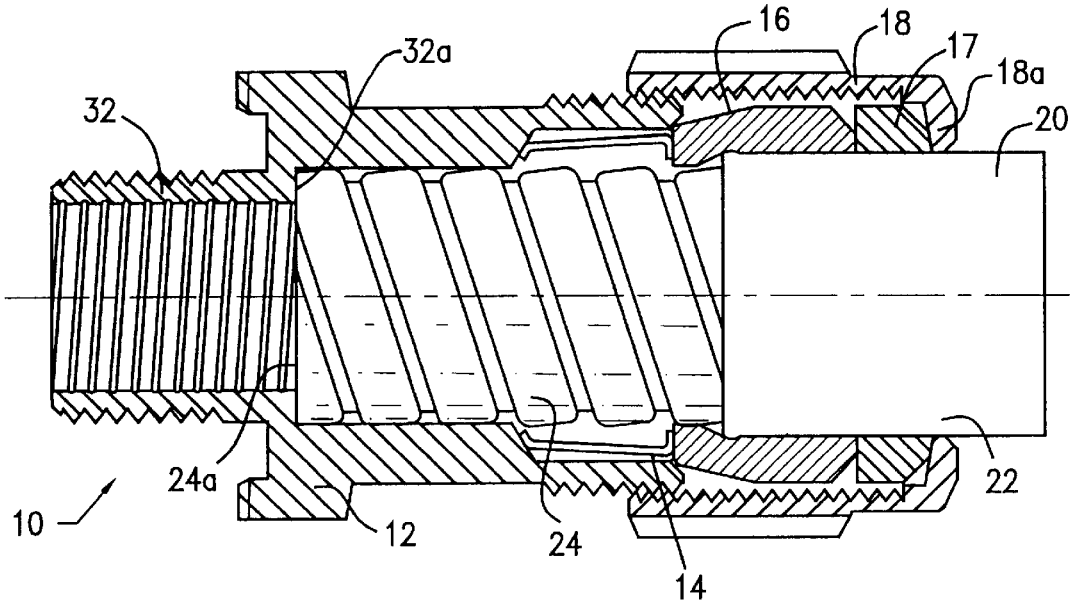
FIGS. 2 and 3 are longitudinal cross-sectional views of a connector of FIG. 1 terminating a first electrical cable with the connector shown respectively in the inserted and terminated positions.
Figure 3:
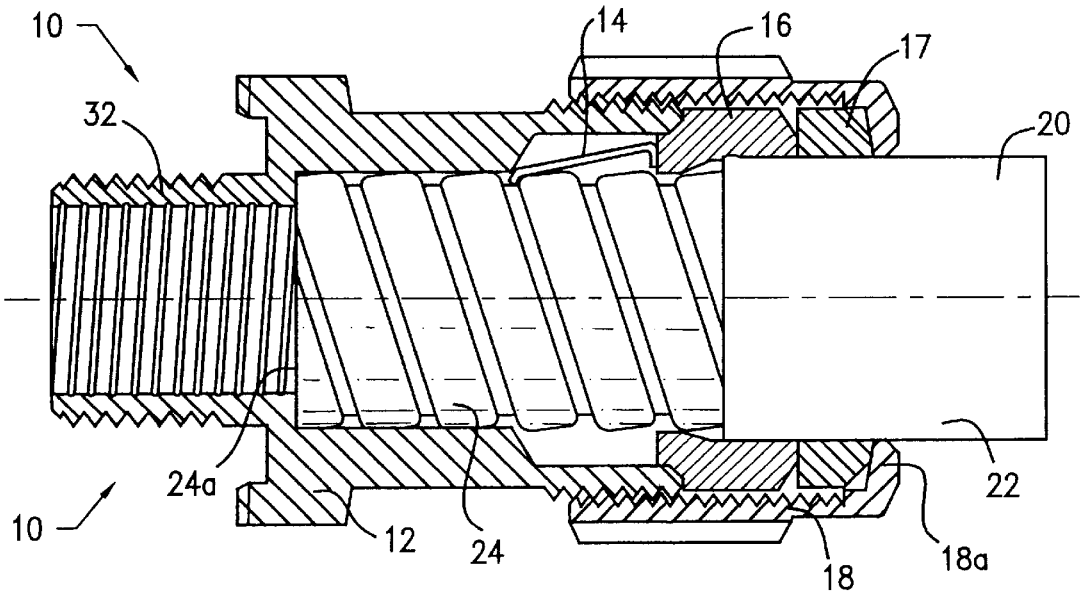

Referring additionally to FIGS. 2 through 5, the connector 10 of the present invention is designed to terminate metal clad cables of at least two different sizes. Referring specifically to FIGS. 2 and 3, metal clad cable 20 includes an outer insulative jacket 22 surrounding a scroll type metallic cladding or sheath 24. A plurality of individually insulated electrical conductors (not shown) extend outwardly through the sheath 24. Similarly, metal clad cable 20' of FIGS. 4 and 5 include an outer insulative jacket 22' surrounding a scroll type metallic cladding or sheath 24' with a plurality of individually insulated conductors (not shown) extending through the sheath 24'.

In typical use, jackets 22 and 22' of the cables 20 and 20' are stripped back so as to expose an end extent of the metallic sheath 24, 24' for termination within connector 10. Connector 10 is designed to terminate a range of cable sizes, including one cable size (as measured by the cable jacket outer diameter) such as metal clad cable 20' having a cable range of between 0.100" to 0.200" and a larger cable size such as cable 20 having a cable range extending up to 0.400".

Referring again to FIGS. 1 through 5, gland body 12 is an elongate hollow generally tubular member having an enlarged cable receiving end 30 which is externally screw threaded and a smaller opposed conductor egressing end 32, which is also externally screwed threaded for attachment to the wall of an electrical box. An internal central bore 34 extends along a central longitudinal axis 33 between cable receiving end 30 and conductor egressing 32.

Gland nut 18 is generally an annular member which may include a hexagonal outer configuration and is internally screw threaded for screw cooperation with the cable receiving end 30 of gland body 12. The rear most end 18*a* is turned radially inwardly to define a flange of reduced diameter and a gland nut opening 28 thereat.

Grounding element 14 is positioned between gland body 12 and gland nut 18 is movable towards the conductor egressing at 32 of gland body 12 upon screw engagement of gland nut 18 with gland body 12. The construction of gland body 12 is such that the grounding element 14 is engageable with an internal wall thereof to urge contact fingers 14*a* and 14*b* of grounding element 14 into mechanical and electrical engagement with the metallic cladding 24 and 24' of cables 20 and 20' as shown in FIGS. 2 through 5. The engagement of grounding element 14 with the cladding of the metal clad cables is more fully shown and described in the above referenced, U.S. Pat. No. 5,059,747.

A first sealing bushing 16 of connector 10 is generally an annular member having a forwardly tapering frustoconical end 38 and rearwardly tapering opposed frustoconical end 39. Frustoconical end 38 of sealing bushing 16 engages a chamfered end portion 40 of gland body 12 adjacent cable receiving end 30 such that upon screw engagement of gland nut 18 with gland body 12 sealing bushing 16 is urged into sealed engagement with cable jacket 22 and 22' to effect the seal therebetween.

A second bushing 17 is employed between first sealing bushing 16 and gland nut 18. Second sealing bushing 17 is generally an annular member having a flat forward end 42 and a rearwardly tapering frustoconical end 44. The second sealing bushing 17 is of a design such that on upon screw connection of gland nut 18 with gland body 12, second sealing bushing 17 is urged against first sealing bushing 16 to effect sealed termination of the jacket 22 and 22' of cables 20 and 20' as will be described in further detail hereinbelow.

Figure 4:
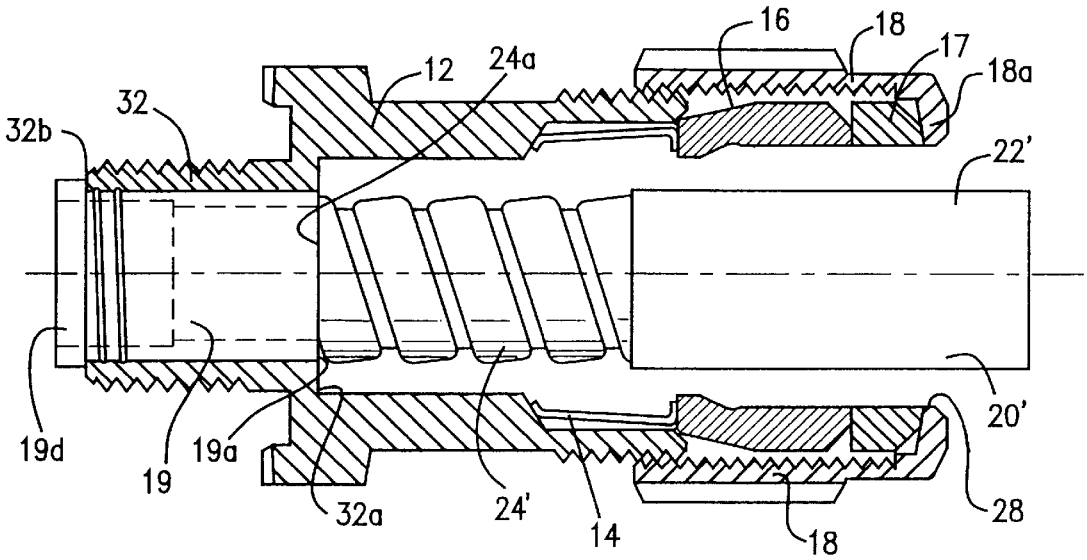
FIGS. 4 and 5 are longitudinal cross-sectional views of the connector of FIG. 1 terminating a second electrical cable with the connector shown respectively in the inserted and terminated position.
Figure 5:
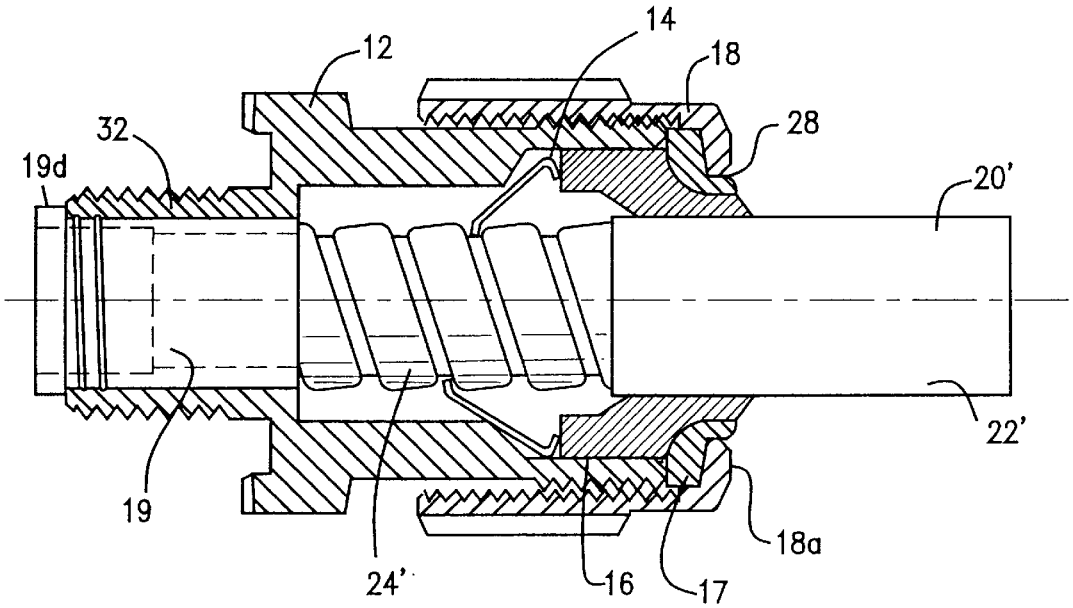
Figure 7:
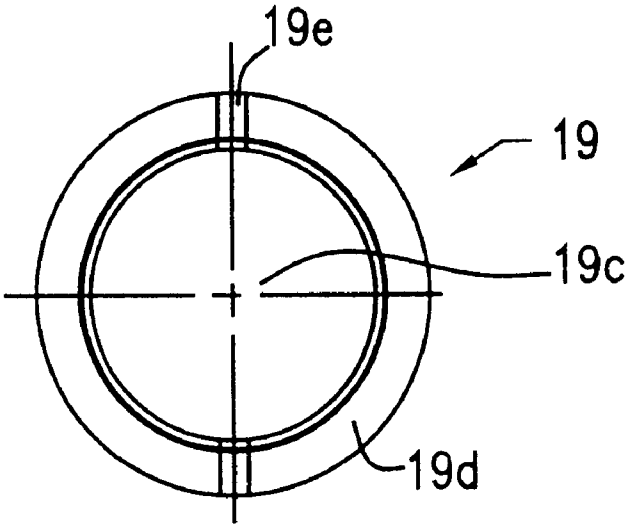
FIGS. 6 and 7 show respectively, a side plan view and a front elevation view of an insert member used in the connector of the present invention as shown in FIGS. 4 and 5.
Figure 6:
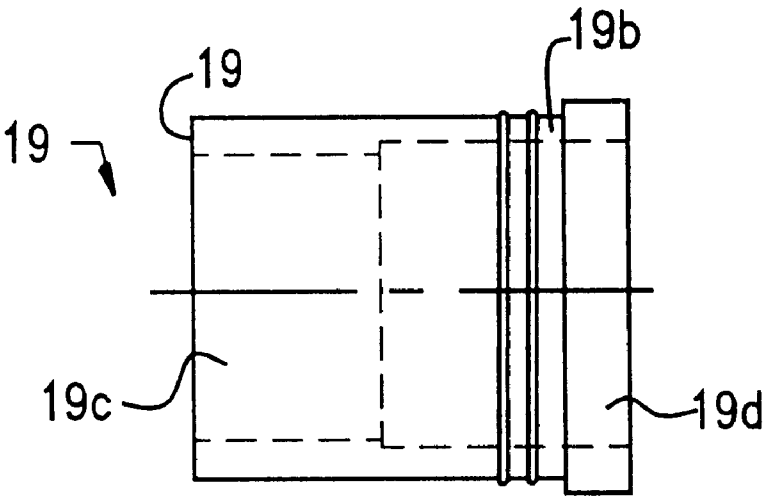

As shown particularly in FIGS. 6 and 7, insert member 19 is a generally cylindrical member having opposed first and second ends 19*a* and 19*b* and a central bore 19*c* therethrough. End 19*b* includes an annularly enlarged collar 19*d* thereat. End 19*b* of insert 19 is externally screw threaded for screw accommodation within cable egressing end 32 of gland body 12 as shown in FIGS. 4 and 5. The upper surface of collar 19*d* includes a slotted location 19*e* for accommodating a tool to permit screw insertion of insert member 19 into cable egressing end 32 of gland body 12.

Having described the components of connector 10, the termination of cables 20 and 20' in connector 10 may now be described.

As shown in FIG. 1 the components are aligned for insertable cooperation. Sealing ring 15 is inserted within annular groove 15*a* and is seated therein for sealed engagement with a wall or panel of electrical junction box or other device upon connection of connector 10 thereto. Grounding element 14 is inserted into the cable receiving end 30 of gland body 12. First sealing bushing 16 is then inserted behind grounding element 14. The second sealing bushing 17 is inserted behind first sealing bushing 16 and gland nut 18 is partially screw threaded onto gland body 12. As shown in FIG. 4 the parts are held in loose accommodation.

Cable 20 is prepared as above described having an exposed end extent of metallic sheath 24 extending from insulative jacket 22. If desired, connector 10 may be connected to a threaded electrical component for sealed connection therewith or may be inserted into an opening in a panel for securement with a locknut (not shown). Cable 20 is then inserted into connector 10 through gland nut opening 28 and through the cable receiving end 30 of gland body 12. Cable 20 is inserted until the distal edge 24*a* of metallic sheath 24 abuts an internal shoulder 32*a* of conductor egressing end 32. This engagement between internal shoulder 32 and the distal end 24*a* of metallic sheath 24 properly aligns and locates cable 20 within connector 10. The conductors extending through cable sheath 24 extend through cable egressing end 32 for exterior electrical termination. Gland nut 18 may then be tightened down to effect the seal between cable 20 and connector 10 and also establish permanent ground continuity between metallic sheath 24 and gland body 12 through grounding element 14. Screw tightening of gland nut 18 may be accomplished by hand or with an appropriate tool.

As shown in FIG. 3, the effects of continued screw engagement of gland nut 18 with gland body 12 are shown with respect to a larger diameter cable 20. Movement of gland nut 18 urges second sealing bushing 17 towards first sealing bushing 16. Continued movement causes deformation of both sealing bushings 16 and 17 against cable jacket 22 of cable 20. Movement of sealing bushing 16 also urges grounding element 14 forward and into ground engagement with metallic sheath 24. Sealing bushings 16 and 17 establish an effective seal between connector 10 and cable 20 at cable jacket 22 as shown in FIG. 3. Such seal is established by the deformation of each of sealing bushings 16 and 17 about cable jacket 22.

Referring now to FIGS. 4 and 5, termination of cable 20' of smaller diameter than cable 20 is also permitted with connector 10. As shown in FIG. 4, connector 10 is assembled substantially as described above, however insert member 19 is positioned within cable egressing end 32 of gland body 12. Insert member 19 is slidably inserted in conductor egressing end 32 until the external threads of the insert member engage the internal threads of conductor egressing end 32. Thereupon the insert member may be screw inserted thereinto until collar 19 abuts against the distal edge 32*b* of conductor egressing end 32. A suitable tool such as a flat blade screwdriver may be employed. Cable 20' is prepared in a manner described above with respect to cable 20. Cable 20 is inserted into connector 10 until the distal edge 24*a'* of metallic sheath 24 abuts against the end 19*a* of insert member 19. As cable 20' is of a diameter smaller than cable 20 the metallic sheath 24 may have a diameter which is less than the internal diameter of conductor egressing end 32. In order to prevent the cable from being continually inserted therethrough, insert member 19 is provided therein. The engagement between insert member 19 and metallic sheath 24 serves to accurately located cable 20' within connector 10. Once cable 20' is properly positioned within connector 10 the gland nut 18 may be tightened down to terminate cable 20' therein.

Upon such screw cooperation between gland nut 18 and gland body 12, sealing bushings 16 and 17 are urged forwardly. As cable 20' has a diameter which is substantially smaller than cable 20 of FIG. 2, significant deformation of both sealing bushings 16 and 17 takes place. Deformation of each of sealing bushings 16 and 17 is such that sealing bushing 17 deforms in a manner where it substantially conforms about inwardly directed flange 18*a* of gland nut 18. Furthermore, sealing bushing 16 deforms in a manner where it conforms about deformed sealing bushing 17 and into direct engagement with cable jacket 22'.

It is further contemplated that on cables of smaller diameters such as shown in FIGS. 4 and 5, sealing bushings 16 and 17 deform in a manner where a portion of the sealing bushings 16, 17 extrude beyond the opening 28 of gland nut 18. This is especially the case with sealing bushing 16 which is extruded outwardly of both deformed sealing bushing 17 and opening 28 of gland nut 18. Sealing bushing 16 is urged against the cable jacket 22'. Further screw engagement between gland body 12 and gland nut 18 causes the sealing bushing 16 to be extruded out through opening 28 of gland nut 18. Simultaneously, sealing busing 17 is urged against deformed sealing bushing 16 forcing it into further engagement with cable jacket 22'. Continued screw tightening causes a portion of both sealing bushings 16 and 17, now in frictional engagement, out through opening 28 of gland nut 18. The ability for sealing bushings 16 and 17 to deform in a manner shown and described with respect to FIG. 5, allows connector 10 to accommodate in a sealed fashion a cable 20' of a smaller diameter without need to employ different components. Thus an installer may employ the identical components to effect the sealed termination of larger cable 20 as well as smaller cable 20'. Only rigid plastic insert member 19 is required with respect to smaller cable 20' so as to accurately locate the cable within connector 10.

Various changes to the foregoing described and shown structures would now be evident to those skilled in the art. Accordingly, the particularly disclosed scope of the invention is set forth in the following claims.

What is claimed is:

1. A connector for alternatively terminating a first electrical cable and a second electrical cable each of said first and second cables including a plurality of conductors extending through an outer jacket, said outer jacket of said first cable having a diameter larger than said outer jacket of said second cable, said connector comprising:

an elongate gland body having a cable receiving end, a conductor egressing end and a longitudinal center bore therethrough for insertable receipt of said cables individually;

a gland nut having a cable passage opening therethrough in axial alignment with said gland body, said gland nut being attachable to said cable receiving end of said gland body;

first and second resilient sealing members being positioned between said gland body and said gland nut and being resiliently deformable for effecting a cable seal upon said attachment said gland nut to said cable receiving end at said gland body;

a portion of said first sealing member being resiliently deformable through said gland nut opening and a portion of said second sealing member being urged into frictional engagement with said resiliently deformed first sealing member upon said termination of said second cable in said connector.

2. A connector of claim 1 wherein said cable receiving end of said gland body is externally screw threaded and said gland nut is internally screw threaded for cooperative screw engagement.

3. A connector of claim 2 wherein said gland nut is axially movable toward said conductor egressing end of said gland body upon said cooperative screw engagement of said gland with said gland nut.

4. A connector of claim 3 wherein said first sealing member includes an annular deformable element which is radially inwardly compressible upon said screw engagement of said gland with said gland nut for sealing engagement with said cable jacket.

5. A connector of claim 4 wherein said gland body includes an inner substantially cylindrical wall having an inwardly directed shoulder portion adjacent said conductor egressing end.

6. A connector of claim 5 wherein said shoulder forms a stop for insertion of said first cable therein.

7. A connector of claim 3 wherein said gland nut includes an inwardly directed annular flange defining a gland nut opening at one end thereof.

8. A connector of claim 7 wherein said second sealing member is an annular element having a passage therethrough and is radially inwardly compressible upon said screw engagement of said gland body with said gland nut.

9. A connector of claim 8 wherein upon said termination of said second cable, said first sealing member is deformable through said passage of second sealing member.

10. A connector of claim 9 wherein said second sealing member is deformable into conformance about said gland nut flange.

11. A connector of claim 10 wherein said second sealing member is deformable through said gland nut opening.

12. A connector of claim 8 wherein upon said termination of said first cable, said first and second sealing members are deformable into sealed engagement with said cable jacket.

13. A kit of parts adapted to terminate an electrical cable having a plurality of electrical conductors extending through an elongate cable conduit, said cable conduit having alternately a first conduit diameter or a second conduit diameter less than said first, said kit of parts comprising:

a connector gland body having a cable receiving end, a conductor egressing end and a central bore therethrough, said gland body including a shoulder inwardly adjacent said conductor egressing end thereof, said shoulder adapted to engage an end of said conduit of said first diameter;

a connector gland nut for attachment to said cable receiving end of said gland body to secure said cable in said gland body;

sealing means adapted for cooperation with said gland body of said gland nut end and for sealing said cable upon attachment of said gland nut to said gland body; and an insert member adapted for insertion into said conductor egressing end of said gland body and positioned adjacent to said gland shoulder, said insert member adapted to engage an end of said conduit of said second diameter.

14. A kit of parts of claim 13 wherein said sealing means includes a first resilient sealing bushing and a second resilient sealing bushing adapted to be positioned between said gland body and said gland nut.

15. A kit of parts of claim 13 wherein said insert member includes an end extent adapted for disposition adjacent said shoulder.

16. A kit of parts of claim 15 wherein said end extent of said insert member is adapted to form a stop for said inserted cable.

17. A kit of parts of claim 13 wherein said insert member is screw attachable to said conductor egressing end of said gland body.

* * * * *